United States Patent [19]

Carter, Jr., deceased

[11] 4,111,362

[45] Sep. 5, 1978

[54] SYSTEM FOR MAKING CARBON DIOXIDE SNOW

[75] Inventor: Thomas A. Carter, Jr., deceased, late of Whittier, Calif., by Donna B. Carter, sole heir

[73] Assignee: Airco, Inc., Montvale, N.J.

[21] Appl. No.: 801,118

[22] Filed: May 27, 1977

[51] Int. Cl.$^2$ ..... A62C 31/14

[52] U.S. Cl. ..... 239/1; 239/499; 239/545; 169/74

[58] Field of Search ..... 239/25, 14, 429, 499, 239/543–545; 169/74

[56] References Cited

U.S. PATENT DOCUMENTS

| | | | |
|---|---|---|---|
| 2,566,324 | 9/1951 | Frese | 239/499 |
| 2,978,187 | 4/1961 | Hesson | 239/499 |
| 3,901,322 | 8/1975 | Winston | 239/499 X |
| 4,002,293 | 1/1977 | Simmons | 239/545 X |

*Primary Examiner*—Robert W. Saifer

*Attorney, Agent, or Firm*—Roger M. Rathbun; Edmund W. Bopp; Larry R. Cassett

[57] ABSTRACT

A carbon-dioxide ($CO_2$) snow-making system comprising a snow horn having an upper chamber into which pairs of jets of $CO_2$ are transversely injected from opposite directions, respectively. The expanding jet mixtures of snow and vapor are directed into collision along paths that lie generally in a single plane so as to intersect at an angle of 180° in a central region of the chamber, thereby to dissipate the kinetic energy of the jets. Where more than two jets are directed into collision at a common point, the intersecting angles are so chosen that the resultant kinetic energy is substantially zero. High velocities and turbulence of the snow-vapor mixture are thereby minimized, and the snow discharges evenly from the chamber and through the horn without sticking thereto for uniform distribution.

12 Claims, 6 Drawing Figures

SYSTEM FOR MAKING CARBON DIOXIDE SNOW

BACKGROUND OF THE INVENTION

In the manufacture of $CO_2$ snow, the use of snow horns or the like, with multiple nozzles for injecting liquid $CO_2$ ($LCO_2$) into a snow chamber for increased production, is well-known practice. In general, the pressurized $LCO_2$ may be directed into the snow chamber or horn along or at various acute angles to the vertical center line of the horn to form $CO_2$ snow during the expansion and vaporization phase. In the conversion, the snow-vapor mixture, especially where several nozzles are used, acquires a large amount of kinetic energy. This results in high velocities and turbulence of the mixtures wich tend to cause snow "sticking" due to impact of snow particles on adjacent walls of the horn; also, irregular distribution of the snow takes place at the horn exhaust.

For overcoming these problems, various methods and devices have been employed for reducing mixture velocities, such as diffusion, abrupt expansion, directional change, etc.; however, these devices have not been entirely satisfactory as the solid snow particles do not follow the law of gases and generally retain a significant part of their kinetic energy. In other words, solid particles of $CO_2$ continue to move at comparatively high velocities so as to impact on adjacent walls; thus, there is a tendency for the snow to accumulate on the walls while passing through the snow horn.

Accordingly, the present invention is concerned with overcoming the problems referred to above, particularly as to turbulence and high velocities of the snow-vapor mixtures within the snow chamber, so that $CO_2$ snow can be produced at a uniform and even rate and without significant sticking on the snow horn walls.

SUMMARY OF THE INVENTION

The invention essentially comprises a snow chamber or horn with a plurality of jet nozzles so located around the chamber periphery as to direct expanding jets of $CO_2$ into the chamber where they impinge and intersect in opposing relation so as to dissipate the kinetic energy thereof.

In particular, the intersecting jets which consist of high-velocity snow-vapor mixtures, are directed along collision courses respectively, generally transversely of the ultimate (downward) direction of snow discharge from the horn. In a preferred form, the jets are paired so as to collide or intersect at 180°. During collision, the inelastic rebound of the impinging jets dissipates the kinetic energy thereof, and especially that of the snow particles.

The essential feature is that the angle or angles of intersection are such that the resultant kinetic energy of all the jets is substantially zero. By so dissipating the kinetic energy of the expanded snow-vapor mixture, the high velocities and turbulence characteristic of many prior art $CO_2$ snow-making devices are practically eliminated. In brief, the mixture velocities, and especially the particle velocities, are reduced to a comparatively low level so that the solid particles (snow) in the mixture which now have very little kinetic energy, are free to fall by gravity through the horn at an even rate without sticking on the sides of the horn. This ensures uniform distribution at a receiving station below.

A principal object therefore of the invention is to provide an improved $CO_2$ snow-making system that is capable of even and uniform snow production, especially without loss of production time, etc., such as due to accumulation of sticking snow on the snow chamber wall, and even and orderly deposition of snow discharged from the horn.

Another object of the invention is to provide improved $CO_2$ snow-making apparatus wherein respective jets of expanding snow-vapor mixtures are directed into a snow chamber in opposition to each other so as to intersect at such angle or angles that the kinetic energy of the opposing jets is dissipated.

Another and related object is to provide improved snow-making apparatus of the character above, wherein respective jets directed along collision paths define a horizontal plane substantially normal to the direction of snow discharge from the snow chamber, and the kinetic energy of the colliding jets is dissipated, whereby high velocities and turbulence of the snow-vapor mixtures within the chamber are effectively reduced.

Other objects, features, and advantages will appear from the following description with reference to the accompanying drawings.

DESCRIPTION OF PREFERRED EMBODIMENT

Figure 1:
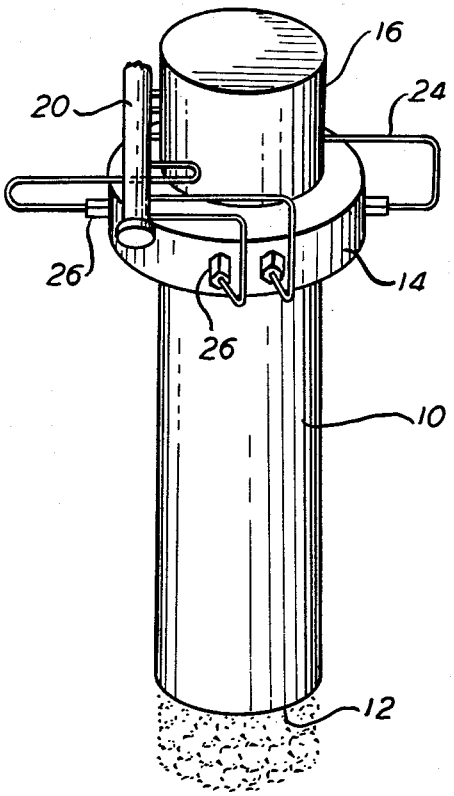
FIG. 1 is an assembly view in perspective of $CO_2$ snow-making apparatus embodying the invention.

The snow horn assembly of the invention shown by FIG. 1 comprises in general a main snow horn section 10 open at its lower or exhaust end 12, a ring-like plate or collar 14 having radially directed jet nozzles leading into an upper part of the horn, and a cylindrical cap section 16 closed at its upper end and mounted above the nozzle plate 14 to form therewith an expansion space. This expansion space which is continuous with that of the horn section 10 generally defines a snow chamber 18, FIG. 3, into which expanding jets of $CO_2$ are directed for making $CO_2$ snow.

Figure 2:
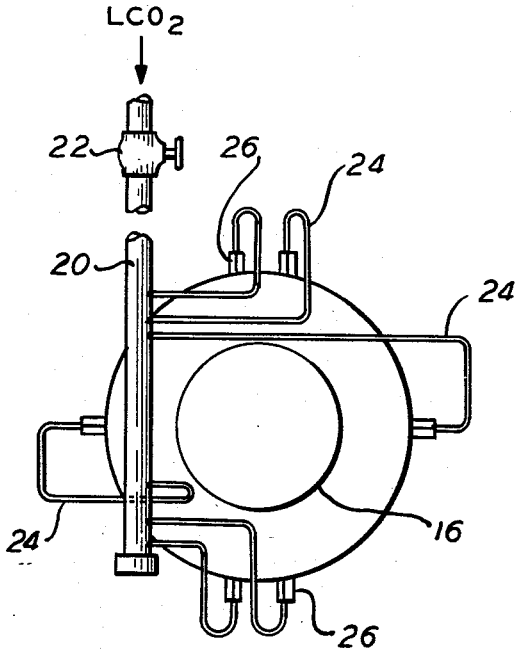
FIG. 2 is a top view of the assembly of FIG. 1.
Figure 3:
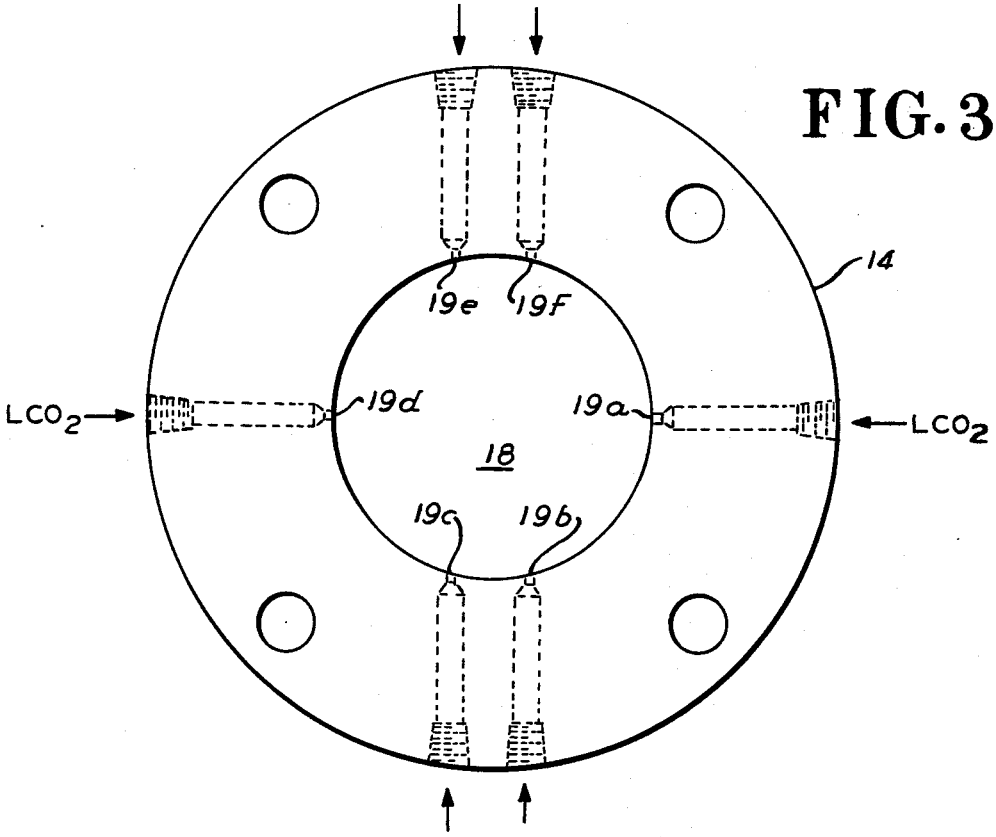
FIG. 3 is a transverse view of the snow chamber of FIG. 1, illustrating the arrangement of the pairs of jet nozzles.

In the disclosed arrangement, the jets of $CO_2$ are transversely directed into the snow chamber 18 through a plurality of nozzles 19*a*, 19*b*, etc., arranged in pairs, generally in a radial direction toward the central part of the chamber from spaced points around the periphery thereof. By way of example only, six jets (three pairs) are indicated by FIGS. 2 and 3, although a greater or lesser number of jets can be used within the scope of the invention. Suitable materials can be used for the components of the snow horn assembly; for example, in a preferred form the snow chamber or horn is made of an aluminum alloy and the jet nozzles of brass.

For producing $CO_2$ snow, a suitable source of $LCO_2$ is connected through a control valve 22 to a supply manifold 20, FIG. 2, which in turn feeds the jet nozzles through conventional tubing and fittings 24 and 26, respectively. Referring in particular to FIG. 3, it will be seen that three pairs of nozzles are arranged so that the nozzles of each pair direct jets of expanding $CO_2$ toward each other on collision paths to impinge and intersect at an angle of 180° near the center of the snow chamber 18. The oppositely disposed pair of nozzles 19*a* and 19*d* for example, direct jets along a linear collision path that is transverse to the longitudinal axis of the snow horn so as to intersect at the center of the chamber, whereas the approximately 90° peripherally spaced pairs 19*b*, 19*f*, and 19*c*, 19*e* may direct opposing jets so as to intersect at respective points somewhat offset from opposite sides of the chamber center. This latter arragement tends to neutralize any tendency of the snow particles to rotate or swirl around the center of the chamber. Irrespective of the precise orientation of a pair of jets with respect to the snow chamber configuration, the opposing jets of a pair are directed into collision courses within a plane so as ultimately to intersect at an angle of substantially 180°, thereby to dissipate the kinetic energy thereof.

Specifically, each of the above-identified pairs of nozzles 19*a*, 19*b* and 19*d*, 19*f*, etc., direct respective jets into collision and 180° intersection along a linear path common to the pair. These paths may generally define a horizontal plane that is in transverse relation to the vertical axis of the snow horn, i.e. normal to the direction of snow exhaust from the horn 10. As the peripherally spaced jet nozzles are positioned for jet discharge in radial, or approximately radial directions, the respective intersections of the jets occur within a central region of the chamber spaced from the walls thereof. This ensures that there is no significant dissipation of kinetic energy by jet impingement on the chamber walls which would result in snow sticking thereto. Instead, the kinetic energy is dissipated by inelastic rebound of the intersecting colliding jets to such extent that residual energy of the snow particles is so reduced that the particle velocities are at very low levels. As a result, there is little or no turbulence within the chamber, and the $CO_2$ snow tends to fall evenly by gravity through the horn without significant sticking. It follows, therefore, that snow from the horn exhaust falls at a comparatively even rate, referring to FIG. 1, so that there is uniform distribution of snow at a receiving station below.

Figure 5:
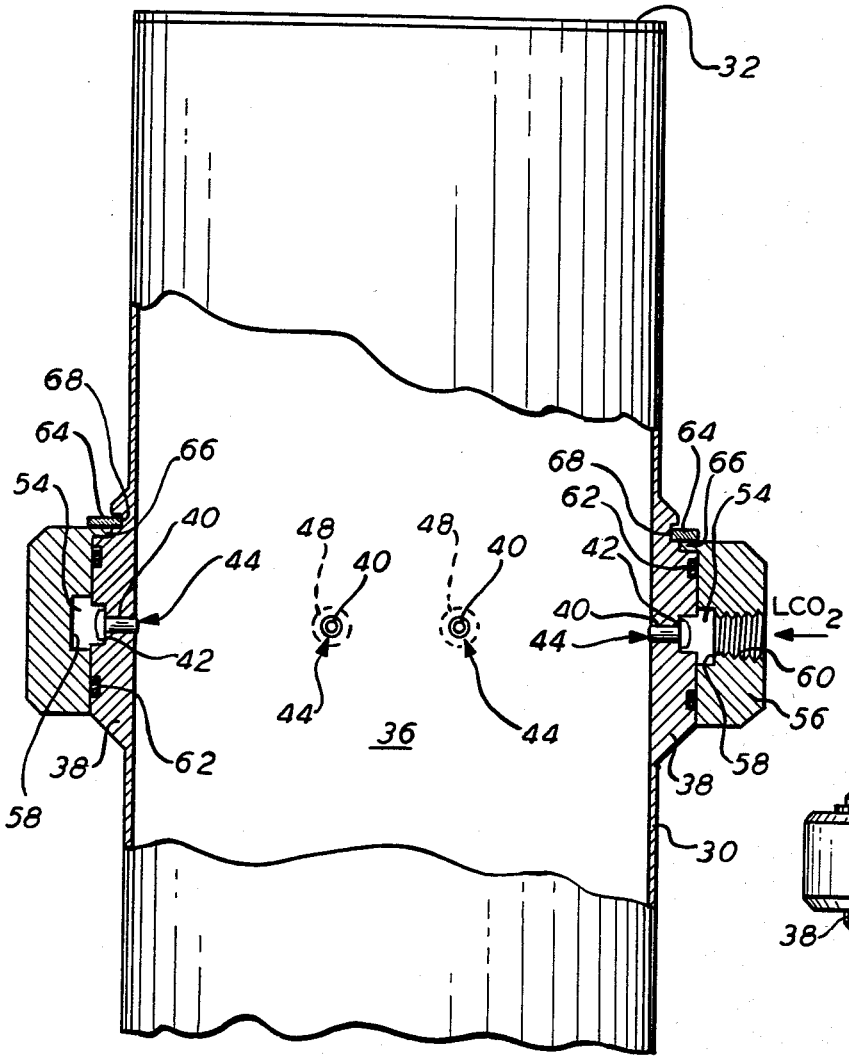
FIG. 5 is an enlarged view partly in section, of manifold and jet nozzle structure of the FIG. 4 assembly.
Figure 4:
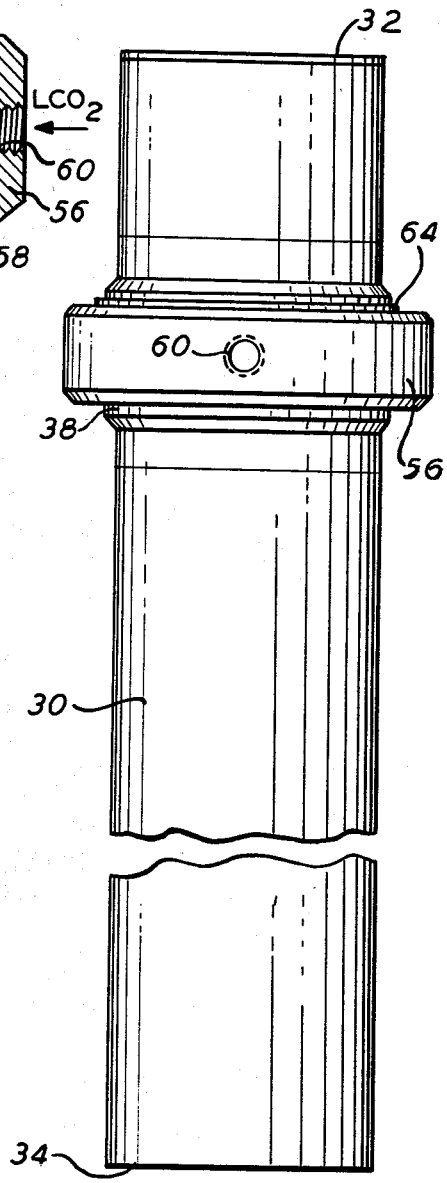
FIG. 4 is a view in elevation of a snow born assembly embodying a modified form of the invention.
Figure 6:
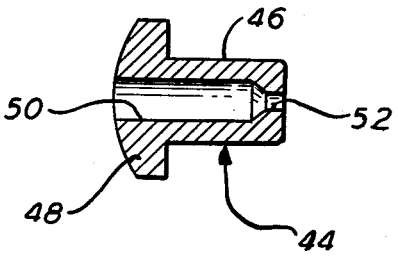
FIG. 6 is an enlarged detail view, in section, of a jet nozzle as shown generally in FIG. 5.

FIGS. 4 and 5 illustrate a simplified snow horn construction wherein the manifold is formed in part by the wall structure of the horn, and the jet nozzles are mounted as individual units in the horn wall. As shown, the snow horn comprises an aluminum cylinder 30 that is closed at its upper end 32 and open at the lower or discharge end 34 of the snow chamber 36. The cylinder has formed on its outer peripheral surface at its upper end, a boss or collar 38 that is spaced from the closed end 32 to form an upper expansion chamber, as in FIG. 1. Peripherally-spaced drilled apertures 40 in the boss communicate with the snow chamber and are countersunk at 42 to form seats for the respective jet nozzles 44, FIG. 6. The nozzles which are formed as inserts for the apertures 40 are made of brass, each nozzle comprising a cylindrical shank portion 46 that fits in a respective aperture 40, and an enlarged head 48 that seats in the recess of countersink 42 in the boss 38. The nozzle passage is formed by a center bore 50 that is reduced in diameter at the entrance to the snow chamber to form a fine jet orifice 52.

The manifold for feeding $CO_2$ to the respective jet nozzles around the periphery of the snow chamber comprises an annular passage 54 that is formed by a tight-fitting ring or band 56 encircling the boss 38 at the jet nozzles. The band 56 has an annular groove 58 at the inner periphery thereof opposite the jet nozzle inlets to form with the boss the annular manifold passage. A tapped opening 60 in the band 56 which communicates with the manifold, can be connected to a suitable source of $LCO_2$, as in FIG. 2.

For sealing the manifold passage, O-rings 62 are seated in grooves as indicated between the boss and band at opposite sides of the manifold. The band has a peripheral positioning flange 66 on its upper inner edge that seats within a corresponding groove in the boss, and that is held in its seat by a conventional retaining or snap-ring 64 that locks into a groove 68 in the boss.

The jet nozzle arrangement and orientation in FIGS. 4 and 5 may be essentially similar to that of FIGS. 1–3, wherein jets are directed along a horizontal plane into intersecting collision for reducing the resultant kinetic energy of the jets to substantially zero.

In general, the arragements of the respective pairs of jets, size of snow chamber in relation to the number of jets, etc., in the invention can be varied from that more or less diagrammatically indicated herein, the essential criteria being that the jets are so positioned and directed into intersecting collision courses that the total kinetic energy of all jets is substantially dissipated and the snow is free to fall evenly through the chamber for uniform exhaust distribution. For example, the invention is not limited to paired jets intersecting at 180°, and may comprehend an odd number of jets, as where three jets of equal intensity are radially directed toward a central point in the chamber to intersect at angles of 120°, respectively. In this instance, the resultant kinetic energy of the three jets is also zero so that turbulence and high velocities of snow-vapor mixtures within the snow chamber are effectively precluded.

Having set forth the invention in what is considered to be the best embodiment thereof, it will be understood that changes may be made in the system and apparatus as above set forth without departing from the spirit of the invention or exceeding the scope thereof as defined in the following claims.

I claim:

1. Apparatus for making carbon dioxide ($CO_2$) snow comprising a snow chamber open at its lower end for snow exhaust, means for supplying liquid $CO_2$ to the chamber, and a plurality of jet nozzle means mounted peripherally of the chamber and connected to the supply means, the jet nozzle means being oriented to direct respective jets of $CO_2$ into the chamber in opposition to each other so as to intersect and substantially dissipate the kinetic energy of all the jets.

2. Apparatus as specified in claim 1 wherein the nozzle means are oriented to direct the respective jets along intersecting paths that generally define a single plane.

3. Apparatus as specified in claim 2 wherein a plurality of pairs of jet nozzle means are oriented to direct the respective jets in a generally radial direction along a horizontal plane and transversely of the vertical axis of the chamber.

4. Apparatus as specified in claim 3 wherein the nozzle means of one pair are positioned for directing the respective opposing jets so as to intersect at a point offset with respect to the center of the snow chamber at one side thereof, and the nozzle means of another pair direct the respective opposing jets so as to intersect at a point offset with respect to the chamber center at the opposite side.

5. Apparatus as specified in claim 1 wherein another pair of nozzle means is mounted for directing opposing jets transversely of the offset center jets so as to intersect at the center of the chamber.

6. Apparatus as specified in claim 1 wherein at least two jet nozzle means are mouted in direct opposition to each other for directing the jets in a common linear path for collision at an angle of substantially 180°.

7. In a system for making $CO_2$ snow including a source of liquid $CO_2$ and a snow chamber adapted to receive expanding jets of liquid $CO_2$ for producing snow, the chamber being open at its lower end for free-fall snow exhaust: the method which comprises directing at least two jets of liquid $CO_2$ into the chamber from opposite sides thereof, and orienting the resulting snow-vapor jet mixtures so as to intersect and substantially dissipate the kinetic energy of the respective jets.

8. The method as specified in claim 7 wherein the jets are directed toward the vertical axis of the snow chamber so as to intersect approximately at the center of the chamber.

9. The method as specified in claim 8 wherein a plurality of pairs of jets are directed for respective intersections generally along a horizontal plane that is normal to the direction of snow exhaust from the chamber.

10. The method as specified in claim 7 wherein the jets of a pair are oriented to intersect each other at an angle of substantially 180°.

11. The method as specified in claim 7 wherein the jets of $CO_2$ are oriented so as to be substantially within a single plane.

12. The method as specified in claim 11 wherein the respective intersections of two pairs of jet arranged for substantially parallel discharges, occur at points offset from the chamber center at opposite sides thereof, respectively.

* * * * *

UNITED STATES PATENT AND TRADEMARK OFFICE

CERTIFICATE OF CORRECTION

PATENT NO. : 4,111,362

DATED : September 5, 1978

INVENTOR(S) : Thomas A. Carter, Jr.

It is certified that error appears in the above-identified patent and that said Letters Patent are hereby corrected as shown below:

Col. 1, line 16, "wich" should read -- which --.

Col. 4, line 67, "1" should read -- 4 --.

Col. 5, line 4, "mouted" should read -- mounted --.

Signed and Sealed this

*Third* Day of *April 1979*

[SEAL]

*Attest:*

RUTH C. MASON
*Attesting Officer*

DONALD W. BANNER
*Commissioner of Patents and Trademarks*